US005428518A

United States Patent [19]

Huang

[11] Patent Number: 5,428,518

[45] Date of Patent: Jun. 27, 1995

[54] CHRISTMAS LAMP SEAT OF DOUBLE LAYER STRUCTURE

[76] Inventor: Peter K. H. Huang, P.O. Box 80-20, Taipei, Taiwan

[21] Appl. No.: 12,383

[22] Filed: Feb. 2, 1993

[51] Int. Cl.[6] ..... F21V 31/02

[52] U.S. Cl. ..... 362/267; 362/249; 362/306; 362/391; 362/396; 362/806; 439/280

[58] Field of Search ..... 439/404, 414, 419, 420, 439/280, 356; 362/226, 249, 250, 267, 377, 378, 806, 306, 310, 389, 390, 391, 396

[56] References Cited

U.S. PATENT DOCUMENTS

| | | | |
|---|---|---|---|
| 2,163,673 | 6/1939 | Garlock | 362/267 |
| 2,491,463 | 12/1949 | Brooks | 439/414 |
| 2,647,246 | 7/1953 | Gilbert | 439/419 |
| 3,609,643 | 9/1971 | Connan | 439/419 |
| 3,670,160 | 6/1972 | Flowers et al. | 362/378 |
| 4,360,859 | 11/1982 | Ziaylek, Jr. | 362/306 |
| 4,432,046 | 2/1984 | Palsson | 362/378 |
| 4,667,276 | 5/1987 | Cheng | 362/249 |
| 4,771,369 | 9/1988 | Hymer | 362/267 |
| 5,021,706 | 6/1991 | Chen | 362/226 |
| 5,161,881 | 11/1992 | Myson | 362/249 |
| 5,213,410 | 5/1993 | Acks | 362/267 |

FOREIGN PATENT DOCUMENTS

| | | | |
|---|---|---|---|
| 1030105 | 5/1966 | United Kingdom | 439/419 |

*Primary Examiner*—Ira S. Lazarus
*Assistant Examiner*—Alan B. Cariaso
*Attorney, Agent, or Firm*—Pro-Techtor International

[57] ABSTRACT

A lamp seat of double layer structure for X'mas lamp string, includes an inner film layer made of soft and elastic material, which envelops a bulb seat and related elements, being of a T shape, having a top transverse pipe with its pipe body having a reduced diameter, and having a vertical pipe body silghtly enlarged, an inner protruding annulet provided in the bottom outer pipe portion thereof snugly pressing against the body of the bulb; an outer cover layer is laid over the outer peripheries of the concaved pipe body of the top transverse pipe and the vertical pipe body, and let the side pipe portions and bottom outer pipe portion be exposed; therefore, the conductor and the pipes and the bulb can be assembled in tight connection relationship to improve the water proofing effect.

4 Claims, 6 Drawing Sheets

PRIOT ART

CHRISTMAS LAMP SEAT OF DOUBLE LAYER STRUCTURE

BACKGROUND OF THE INVENTION

For raising the festival atmosphere of X'mas day, strings of X'mas lamps are often hung on at many places, especially the intermittent flashing lamp strings, which can increase the atmosphere of joy as well as induce a video sense of merriness.

X'mas lamps not only are disposed on the decorating matters such as indoor X'mas trees, or on the outdoor trees, but also on the whole buildings in long strings of lamps. The indoor X'mas lamps are less affected by the climate, but the lamps hung on outdoors are often affected by the climate, and particularly in the season near the end of a year, there are rains or snows, the existing X'mas lamps often have the defect of water infiltration.

As shown in FIG. 1, the lamp string therein used for X'mas lamps is of a structure of cheaper as well as simpler type. Wherein it includes generally a seat body 10 for the lamp seat, a conductor 11 for stringing up a plurality of lamps extends through a hollowed pipe 12 and connects with the seat body 10. A small lamp bulb 13 is located beneath the seat body 10.

Such lamp seat 10 used in a conventional X'mas lamp basically at the top entrance of the body 10 for the conductor 11 extending through the pipe 12 is exposed. I.e., the diameter of a through-hole 14 in the pipe 12 or of a hole (not shown) on the top end 15 of the body 10 set for pulling in of the conductor 11 is much larger than that of the conductor 11 itself. So that when this amp string is hung on outdoors, it can often be out of work by the infiltration of rain or melting snow, it thus can even induce danger.

Similarly, because the small bulb 13 is threaded into the interior of the body 10 from the bottom end thereof, and the body 10 is normally made of plastic material which envelops directly the interior metallic cap for threadably engaging therewith, so that when the bulb 13 is locked in position, a seam 16 thereof can often create a gap as to let the rain infiltrate into the interior of the body 10 to induce a short circuit at the metallic connection.

The X'mas lamp string as shown in FIG. 2 has a seat body 20 which is formed with an integrally molded hanging hook 21 on one side thereof, a conductor 22 is extended directly through a diametrical hole 23 at the top of the body 20; a protecting cover 24 is provided at the bottom end of the body 20, such that when the bulb 25 is locked into the body 20, the protecting cover 24 can surround and thereby protect the bulb 25. Such kind of structure has the better sealing and better infiltration proof at the joint for the bulb 25, nevertheless, the connecting points thereof with the conductor 22 still have the big possibility of rain infiltration,this is still undesired.

SUMMARY OF THE INVENTION

The present invention is therefore relates to an improved device of a lamp seat in a X'mas lamp string, and especially to a double layer structure of the lamp seat, which can prevent from the water infiltration created when it is used outdoors.

The object of the present invention is to provide an improved lamp seat structure in a X'mas lamp string, the lamp seat itself is integrally ejection molded and has an inner film layer and an outer cover layer, the inner film layer envelops directly on the metallic cap and the conductor, thereafter the molded outer cover layer can envelop thereon, the connecting areas of the inner film layer with the conductor and the bulb are partially exposed, yet a protruding annulet is preset at the bottom the inner film layer, so that the lamp seat, the conductor and the bulb can be assembled in a tight sealing condition with the soft and elastic inner layer of the seat, and thereby the water can be prevented from infiltrating into the interior of the lamp seat.

The novelty as well as other features of the present invention will be apparent from reading the detailed description of the embodiment thereof in referring to the accompanying drawings.

DETAILED DESCRIPTION OF THE PREFERRED EMBODIMENT

Figure 1:
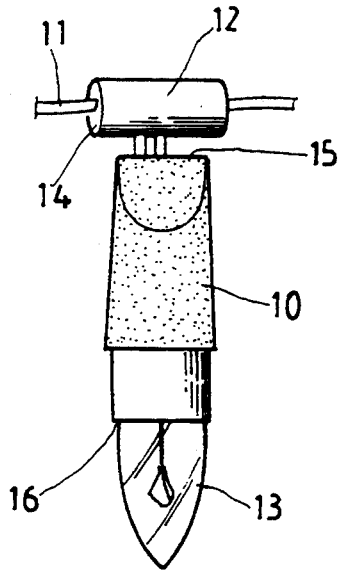
FIG. 1 is a schematic view showing the lamp seat in a conventional X'mas lamp string.
Figure 2:
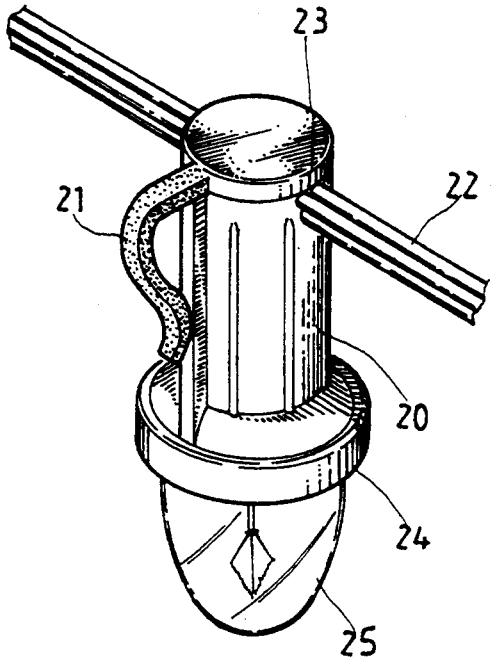
PRIOR ART FIG. 2
FIG. 2 is a schematic view of another conventional X'mas lamp.
Figure 3:
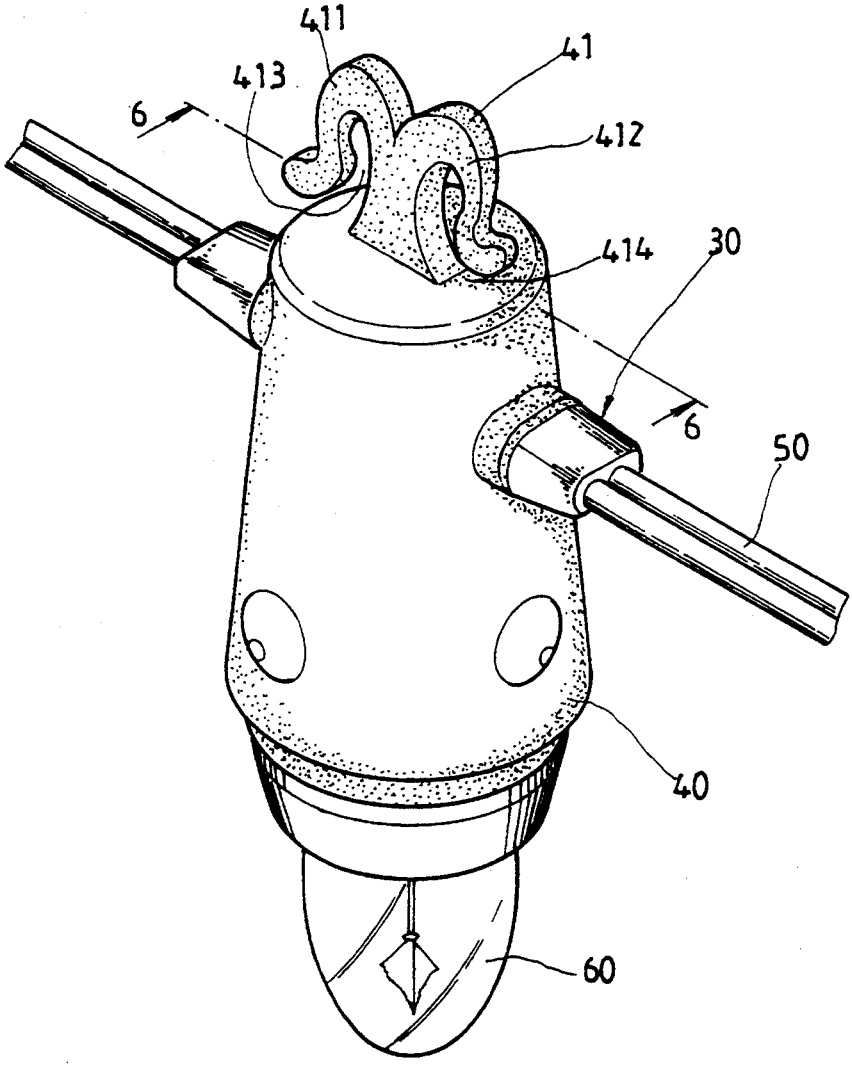
FIG. 3 is a perspective view of the present invention.
Figure 4:
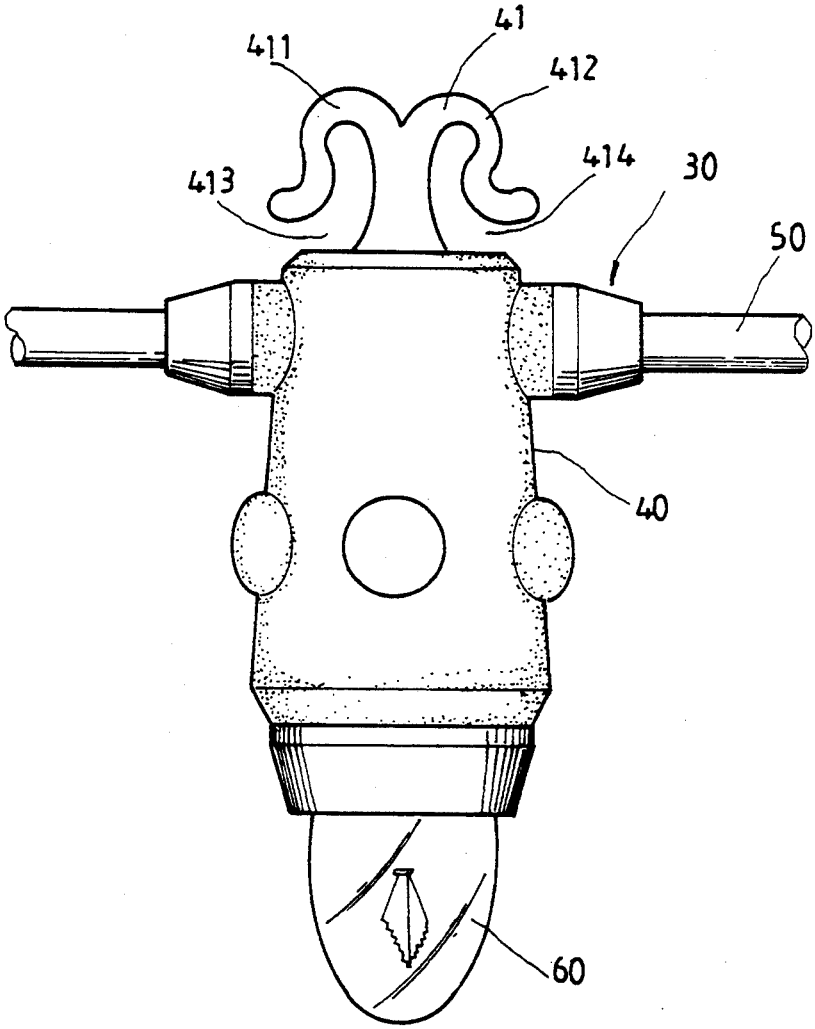
FIG. 4 is a front view of FIG. 3.

Referring to FIGS. 3, 4, the present invention includes generally an inner film layer 30 and an outer cover layer 40, a conductor 50 extends transversely at the upper position through the inner film layer 30, a bulb 60 is inserted into the bottom end of a copper bulb seat 31. The inner film layer 30 can be seen partially exposed in the drawings.

Figure 5:
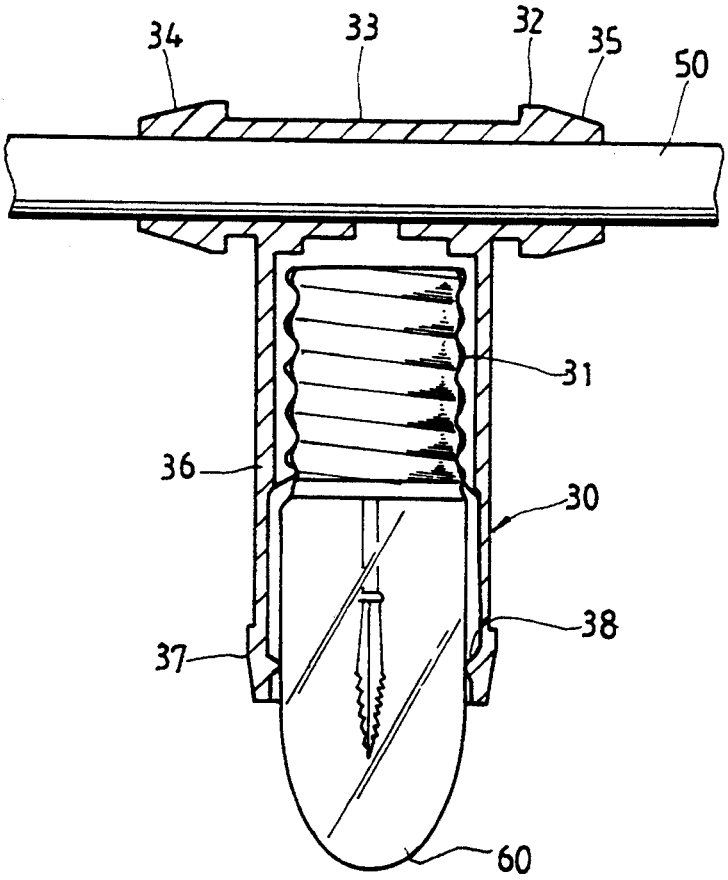
FIG. 5 is a sectional view taken from the section line A—A in FIG. 3.

As shown in FIG. 5, the inner film layer 30 is ejection molded as a whole from a soft and elastic material such as relatively soft plastic and rubber material, which layer can envelop therein the bulb seat 31 when being ejection molded. The inner film layer 30 is formed to have a T shape; the top transverse pipe 32 thereof has a central portion 33 which is of a smaller diameter than two end portions 34, 35, and is of suitable length, the conductor 50 can extend through the throughhole therein. The vertical pipe body 36 thereof also provides a bottom outer pipe portion 37 slightly enlarged, the pipe body 36 is interconnected orthogonally with the top transverse pipe 32. The bulb seat 31 is enveloped in the inner bore of the pipe body 36, while the bottom outer pipe portion 37 has at about the medium thereof an integrated inner protruding annulet 38.

Figure 6:
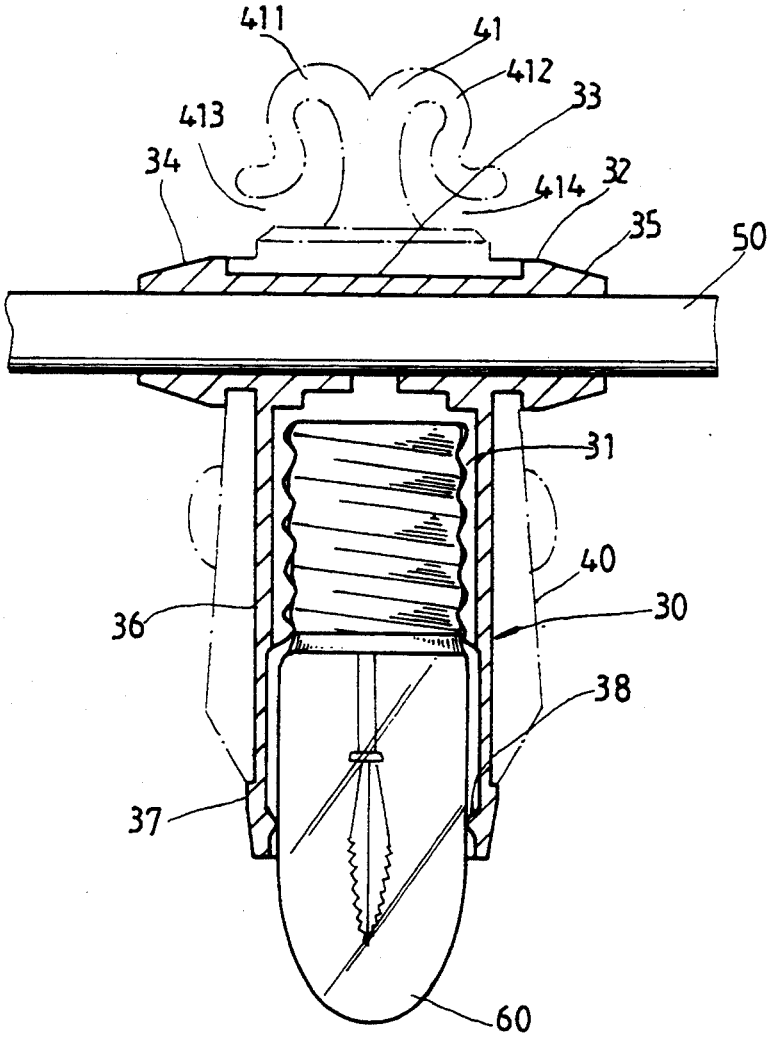
FIG. 6 is a view similar to FIG. 5, showing an outer cover layer is enveloping the inner film layer.

As shown in FIG. 6, when the inner film layer 30 has been ejection molded, a molded outer cover layer 40 can envelope thereon; the outer cover layer 40 is ejection molded directly from a harder plastic material. The outer cover layer 40 had better be laid over the outer peripheries of the top transverse pipe 32 and the vertical pipe body 38 of the inner film layer 30, but let the side pipe portions 34, 35 and the bottom outer pipe portion 37 be exposed. In addition, the outer cover layer 40 can be formed on the top end thereof a hanging hook 41 of a shape having twin bends. i.e., the hanging hook 41 is provided with two arcuated strip portions 411, 412 to form the spaced gaps 413, 414 with the outer cover layer 40, so that the twin bend hanging hook 41 can suit better for hanging on the X'mas tree or the like.

The primary advantages of the present invention resides in that: the conductor 50, bulb seat 31 and the light bulb 60 can be more effectively shielded form moisture after they are assemble because they are all tightly enveloped within the soft and elastic inner film layer 30. And especially as shown in FIG. 5, when the metallic end of the light bulb 60 is threadably connected with the bulb seat 31, the glass body thereof can be clamped by the inner protruding annulet 38 at the bottom of the vertical pipe body 36 to provide a more tight water proofing effect.

Another obvious advantage is that the material of the lamp seat may be bulked by heat after a long term lightening of light bulb 60; while the prior lamp seats are ejection molded from a single material, it is quite easy to enlarge the gaps existed at the various connections and to induce the water filtration by heat bulking; and the present invention provides the inner and outer layers of different moduluses of expansion, the inner layer having larger expansion volume can be limited by the outer layer having smaller expansion volume, therefore, the present invention can have better effect of water proofing than the conventional one in a long term lightening.

According to the above statements, the present invention provides an improved lamp seat in the X'mas lamp string, the conductor or the light bulb thereof can have a better water proofing ability, thereby when it is used outdoors, the possibility of water infiltrating into the interior of the lamp seat is effectively reduced. While various changes may be made in the detailed construction, it is understood that such changes will be within the spirit and scope of the present invention.

What I claim is:

1. A lamp seat of double layer structure for a X'mas lamp string comprising:

an inner film layer and an outer cover layer, said inner film layer being ejection molded from soft and elastic material and enveloping a metallic bulb seat, the bulb seat being in communication with a conductor extending through a through-hole provided at an upper end of said inner film layer, the bulb seat accepting a light bulb in an inner bore of said inner film layer;

said inner film layer enveloping said bulb seat and said conductor;

said inner film layer, said bulb seat, and said conductor being enveloped by said outer cover layer, said outer cover layer being ejection molded from a material that is harder than said inner film layer, said inner layer being pliant so as to provide sealing means for lamp seat, said outer layer being rigid to provide containment and protection means for said lamp seat.

2. The lamp seat as claimed in claim 1 wherein:

said inner layer is substantially T-shaped and includes a top transverse pipe of sufficient length to effectively seal the seat and a bottom enlarged outer pipe portion on a vertical pipe body of said inner film layer;

said outer cover layer enveloping the periphery of the inner film layer but including openings for said conductor and for said bulb.

3. The lamp seat as claimed in claim 1 wherein:

in inner protruding annulet is provided in said inner bore at a lower end of said inner film layer.

4. The lamp seat as claimed in claim 1 wherein:

said outer cover layer has a hanging hook with twin bends, said hanging hook being integrally formed on a top of said outer cover layer.

* * * * *